United States Patent [19]

Hurst et al.

[11] 4,233,929

[45] Nov. 18, 1980

[54] APPARATUS FOR THE TREATMENT OF TIMBER

[75] Inventors: Robert G. Hurst, High Wycombe; Alan L. Pinner, Beaconfield, both of England

[73] Assignee: Protim International Limited, Marlow, England

[21] Appl. No.: 1,803

[22] Filed: Jan. 8, 1979

[51] Int. Cl.[3] ..... C23C 13/08; C23C 11/00; B05D 3/00

[52] U.S. Cl. ..... 118/50; 118/304; 118/682; 118/699; 427/254; 427/297; 427/298; 427/420; 427/440

[58] Field of Search ..... 427/8, 254, 297, 298, 427/420, 440; 118/50, 50.1, 326, 304, 682, 699

[56] References Cited

U.S. PATENT DOCUMENTS

| | | | |
|---|---|---|---|
| 2,334,586 | 11/1943 | Shipley | 118/50 |
| 2,853,047 | 9/1958 | Walter et al. | 118/50 X |
| 2,858,795 | 11/1958 | Walker | 118/50 |
| 3,469,560 | 9/1969 | Bukkila | 118/50 X |
| 3,759,217 | 9/1973 | Weigmann | 118/50 X |
| 3,842,796 | 10/1974 | Hilditch et al. | 118/50 |
| 3,859,046 | 1/1975 | Hurst et al. | 427/8 X |
| 3,895,138 | 7/1975 | Sewell et al. | 427/298 |
| 3,968,276 | 7/1976 | Allen | 427/440 X |
| 3,981,791 | 9/1976 | Rosvold | 118/50 X |
| 4,062,991 | 12/1977 | Kyte et al. | 427/297 |
| 4,086,056 | 4/1978 | Hanson | 427/440 X |
| 4,142,009 | 2/1979 | Kyte et al. | 427/297 |
| 4,184,448 | 1/1980 | Aichert et al. | 118/50 X |
| 4,191,795 | 3/1980 | Lewis | 427/440 X |

*Primary Examiner*—Edward C. Kimlin
*Attorney, Agent, or Firm*—Casear, Rivise, Bernstein & Cohen, Ltd.

[57] ABSTRACT

An apparatus for the treatment of timber comprises a vessel having at least three chambers arranged in series for passage of the timber therethrough on conveyor belts or the like. There is means for drawing a vacuum in each of the end chambers and means for spraying the timber with a preservative liquid in an intermediate chamber, the vacuums being maintained during passage of the timber through the end chambers, by means of seals which are arranged to close and open automatically as the timber enters and leaves the respective vacuum chambers.

7 Claims, 2 Drawing Figures

APPARATUS FOR THE TREATMENT OF TIMBER

The invention relates generally to an apparatus for the treatment of timber, and more particularly to an apparatus for the vacuum impregnation of timber with a liquid containing a preservative against insect, fungal, fire or other attack.

In U.S. Pat. No. 3,859,046, there is described and claimed a timber treatment plant adapted to treat batches of timber by a double vacuum impregnation technique. Such plants have proved their worth but they can represent a delaying factor in an automated treatment system in a timber yard because of the need to treat timber in batches.

It is an object of this invention to provide a double vacuum impregnation apparatus which can be operated on a continuous basis.

This and other objects of the invention are achieved by providing an apparatus for the treatment of timber, comprising a vessel having at least three chambers arranged in series for passage of the timber therethrough, means for drawing a vacuum in each of the end chambers and means for spraying the timber with a preservative liquid in an intermediate chamber, there being at the ends of the vessel and between the chambers, seals adapted to maintain the vacuums in the end chambers.

Preferably the vessel is elongated and straight but it can also be curved. Most preferably the apparatus is so constructed that the timber to be preserved, typically a door, can be conveyed through the apparatus in the upright position.

This apparatus has a considerable advantage over the earlier batch treatment apparatus in which such doors must be stacked for treatment in the apparatus and afterwards they must be unstacked for use in the timber yard.

Most preferably the apparatus is arranged so that a number of items of timber such as doors may be treated together. For this purpose it is preferable to pass the doors through the apparatus on a conveyor belt, or conveyor belts.

The spray system is preferably a high pressure spray system of the type known to produce a cascade or deluge effect. Preferably the spraying apparatus is located in the ceiling of an intermediate chamber. It is preferred, according to the invention, to provide in addition a tank of liquid in the floor of the spray chamber, and to pass the door through the chamber such that the lowermost portion of the door is immersed in the liquid in that tank. The liquid may be recirculated.

Figure 1:
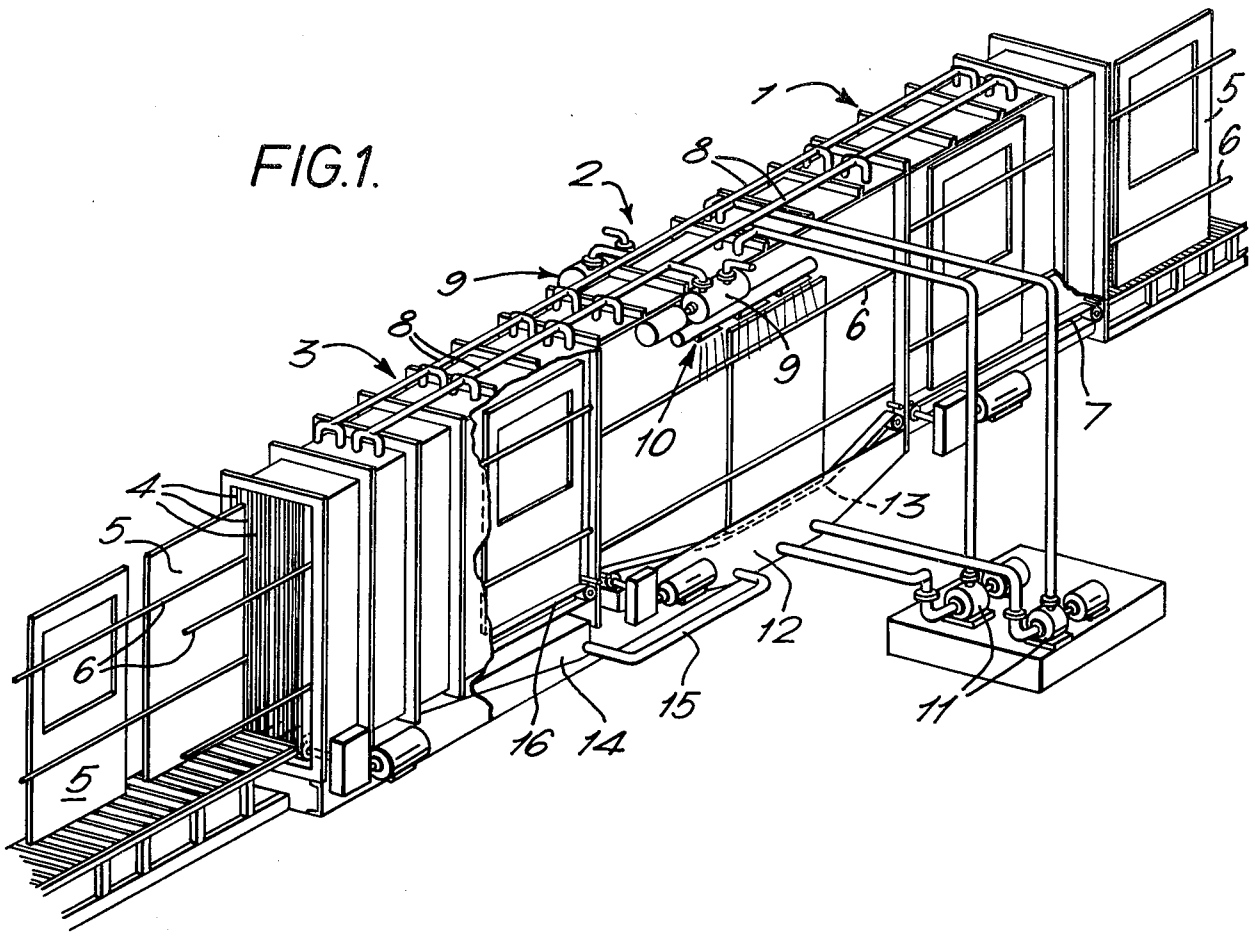
Figure 2:
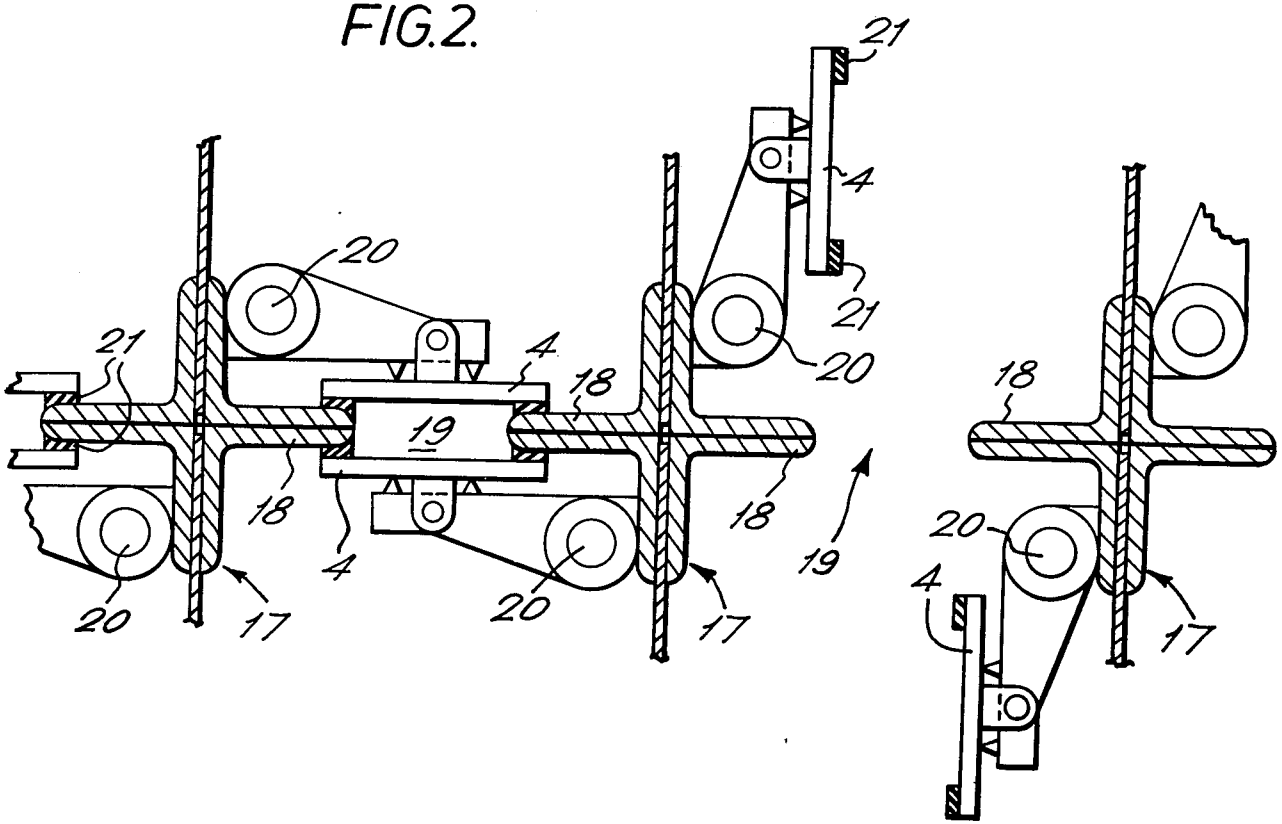

Other objects and many of the attendant advantages of the invention will be readily appreciated as the same becomes better understood by reference to the following detailed description when considered in connection with the accompanying drawings wherein:

FIG. 1 is a perspective view of an apparatus for the treatment of timber according to the invention, and FIG. 2 is a detail of the seals of that apparatus.

The apparatus comprises a pressure-resistant vessel of rectangular cross-sectional shape having three intercommunicating chambers arranged in line. The chambers are, from the right hand end of the drawing, an entry initial vacuum chamber 1, an impregnation chamber 2 and a final vacuum chamber 3.

At both ends of the apparatus and between the chambers are a plurlity of parallel doors 4 provided with pressure seals, as indicated generally at the left hand end of the plant. The doors 4 and associated seals are discussed below in connection with FIG. 2. The timber 5 to be treated, in this case being doors, is arranged in the upright position. Guides 6, preferably of Nylon or the like, run the length of the plant to guide the timber doors 5 in their passage through the chambers so that a number of doors may be treated together.

The initial vacuum chamber 1 has a set of parallel conveyor belts 7 located in the floor. Piping 8 in the roof of the chamber 1 is connected to vacuum pumps 9 and the same piping is also connected to a final vacuum chamber 3. The impregnation chamber 2 has in its ceiling a high pressure spray head system 10 arranged to deliver a cascade of impregnation liquid drawn from a reservoir, not shown, by a set of high volume delivery centrifugal pumps 11.

The floor of the impregnation chamber 2 forms a tank 12 to collect liquid cascading from the spray system 10 and this liquid is then recycled by the pumps 11. To one side of the tank 12 there is located a wall within the tank to act as a weir, as explained below. A set of conveyor belts 13 is located in the floor of the chamber 2 and the belts are arranged such that when conveying timber doors 5, the lower portion of the doors passes through the liquid in the tank 12. The floor of the final vacuum chamber 3 slopes downwardly as shown at 14 and liquid drawn from the timber doors 5 under the final vacuum, drains on to this floor and is then conveyed via piping 15 into the tank 12 of the impregnation chamber 2.

A set of conveyor belts 16 is located in the final vacuum chamber 3.

FIG. 2 shows in detail the structure of the doors 4 and their associated seals. Door frames 17 are formed of rolled steel angle iron and these frames have flanges 18 which are space apart to define between pairs of frames a gap 19 to allow a piece of timber to be treated to pass therebetween. In the corner of each frame on each side of the gap 19 is a shaft 20 about which pivots a spring loaded door 4. Rubber of like sealing blocks 21 are present at each edge of the door 4. The doors 4 are normally held one on each side of the gap 19, so sealing the gap and preventing loss of pressure or vacuum as appropriate.

In operation, as the timber 5 to be treated approaches the doors 4, the timber actuates a switch, not shown, which causes the doors 4 to pivot about the respective shaft 20 away from the gap 19 so allowing the timber 5 to pass therethrough. A timer device, also not shown, is used to control the period for which the doors 4 are held away from the gap 19.

In using the apparatus, the timber doors 5 are held upright and are fed into the initial vacuum chamber 1 on the belts 7. As they travel through that chamber separated by the guides 6, they are subject to a vacuum of the order of 10 inches of mercury, so that by the time they reach the impregnation chamber 2, the timber cells have been adequately evacuated. In the impregnation chamber 2 the timber doors 5 are sprayed by the spray system 10. The liquid cascades down to deluge the timber doors 5 and in so doing is drawn into the timber cells. The lower portion of the timber doors 5 passes on the belt 13 through the liquid in the tank 12. When the level of the liquid present in the tank rises above the interior weir wall, not shown, the excess cascades over that wall and is passed by the pumps 11 back to the spray system 10. The timber doors are then passed into the final vacuum chamber 3 where they are subjected to a vacuum of the order of 25 inches of mercury to draw off excess liquid, and this drains down the floor 14 and via the pipe 15 into the tank 12 of the impregnation chamber 2. The doors leave the plant at the exit and are then removed for further processing in the timber yard.

The degree of treatment at any stage may be controlled by the speed of the conveyor belts which gives a simple but effective control. To minimise loss of vacuum it is possible to subdivide each of the chambers 1 and 3 into an inner main section and an outer section with a set of doors 4 in between. In this way only the outer section is in contact with the atmosphere. The preservative will typically be presented in an organic solvent such as white spirit. Although reference has been made to the treatment of doors, other items of timber may be treated such as planks or garden fences.

Without further elaboration the foregoing will so fully illustrate the invention that others may, by applying current or future knowledge, readily adapt the same for use under various conditions of service.

What is claimed as the invention is:

1. An apparatus for the continuous treatment of a sucession of individual generally elongate items of timber, comprising a vessel having at least three chambers arranged in series for passage of the timber therethrough, means for drawing a vacuum in each of the end chambers and means for spraying the timber with preservative liquid in an intermediate chamber, guide means for holding the timbers upright, conveying means for transporting the upright timber sequentially through said chambers, sealing means adapted to maintain the vacuums in the end chambers, said sealing means being located at the ends of the vessel and between said chambers and timing means to control the period of treatment in the chambers.

2. The apparatus of claim 1, in which the vessel is elongated and the chambers are arranged in line.

3. The apparatus of claim 2, wherein said conveying means comprises at least one belt arranged to transport the timber through the chambers.

4. The apparatus of claim 1 wherein the sealing means comprise seals provided on doors and which are arranged to open and close automatically to allow passage of the timber therethrough.

5. The apparatus of claim 4, in which the means for spraying in the intermediate chamber comprises a high pressure spray to produce a cascade or deluge effect.

6. The apparatus of claim 5, additional comprising a tank of liquid in the floor of the spray chamber, and wherein the timber being treated is passed through the chamber such that the lowermost portion of the timber is immersed in the liquid in said tank.

7. The apparatus of claim 1 wherein said guide means extends through each of said chambers.

* * * * *